United States Patent [19]

Cubbler, Jr. et al.

[11] 3,979,874

[45] Sept. 14, 1976

[54] SUSPENDED CEILING SYSTEM AND RUNNER JOINTS THEREFOR

[75] Inventors: Ralph J. Cubbler, Jr., Oklahoma City; Kyle E. Lucas, Stroud, both of Okla.

[73] Assignee: Alabama Metal Industries Corporation, Birmingham, Ala.

[22] Filed: Nov. 24, 1972

[21] Appl. No.: 309,258

[52] U.S. Cl. ..... 52/664; 52/484; 52/758 A

[51] Int. Cl.[2] ..... E04B 5/55; F16B 7/22

[58] Field of Search ..... 52/664, 484, 667; 287/189.36 A

[56] References Cited

UNITED STATES PATENTS

| | | | |
|---|---|---|---|
| 3,221,466 | 12/1965 | Downing et al. | 287/189.36 A X |
| 3,305,256 | 2/1967 | Znamirowski | 52/484 X |
| 3,374,596 | 3/1968 | O'Brien et al. | 52/484 X |
| 3,396,997 | 8/1968 | Adams | 52/484 X |
| 3,399,915 | 9/1968 | Stanzak | 287/189.36 A |
| 3,606,417 | 9/1971 | Rousey | 52/667 X |
| 3,746,379 | 7/1973 | Sauer | 287/189.36 A |

*Primary Examiner*—Price C. Faw, Jr.
*Assistant Examiner*—Leslie Braun
*Attorney, Agent, or Firm*—Laney, Dougherty, Hessin & Fish

[57] ABSTRACT

A suspended ceiling system employing a plurality of main and cross runners for supporting a plurality of ceiling panels, with both the main and cross runners being provided with means for supporting the ceiling panels. Also disclosed are interlocking joint means formed on each end of a respective main runner for interconnection with a like main runner, and interlocking joint means formed on each end of a respective cross runner for interconnection with a like cross runner and the medial portion of a respective main runner disposed therebetween.

9 Claims, 12 Drawing Figures

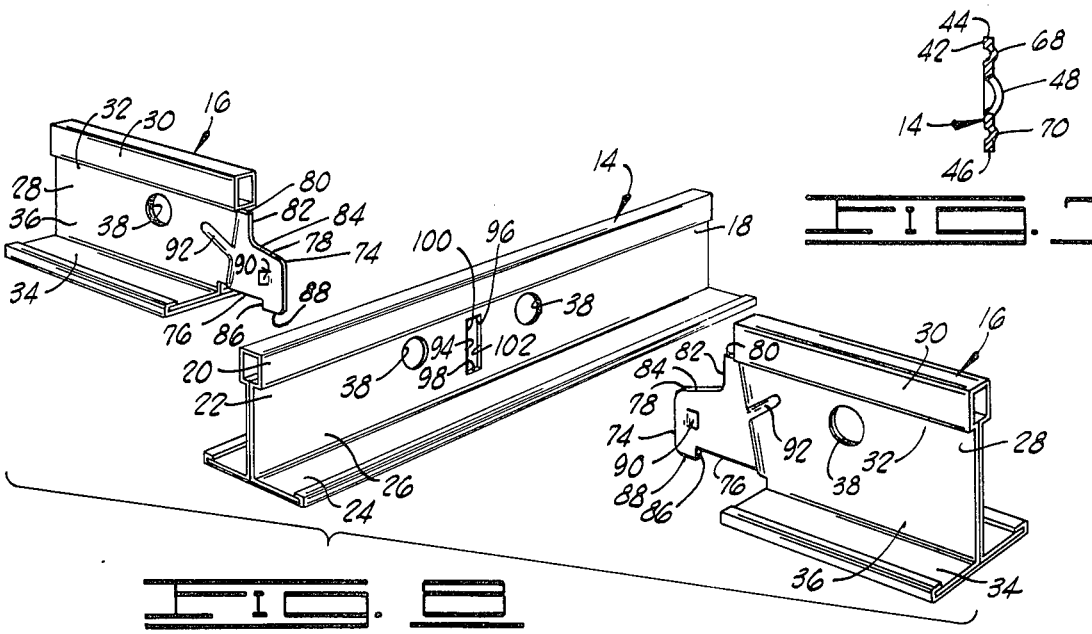
FIG. 8
FIG. 7
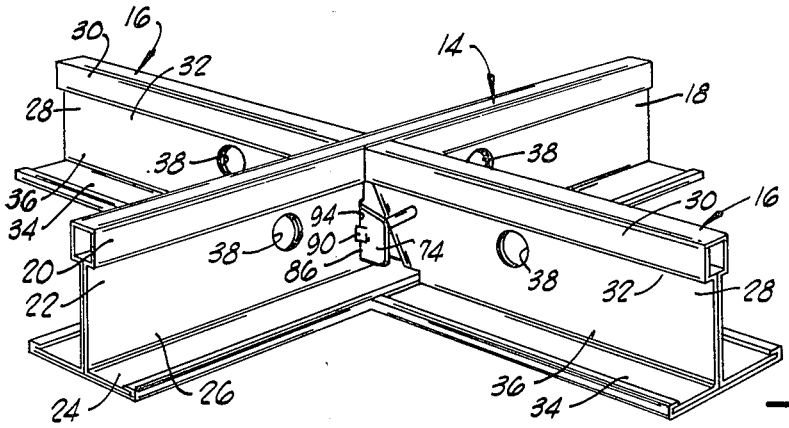
FIG. 9
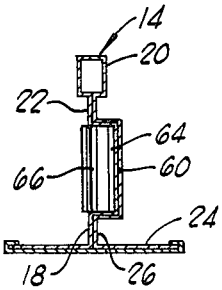
FIG. 6
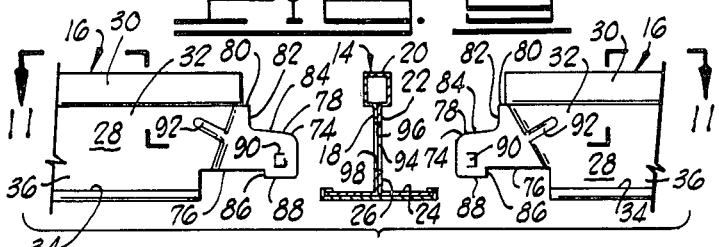
FIG. 10
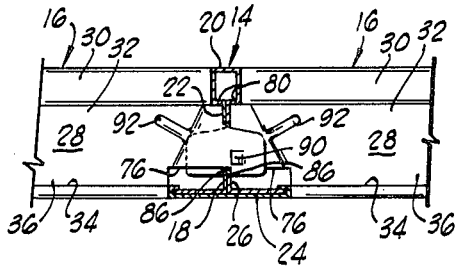
FIG. 12
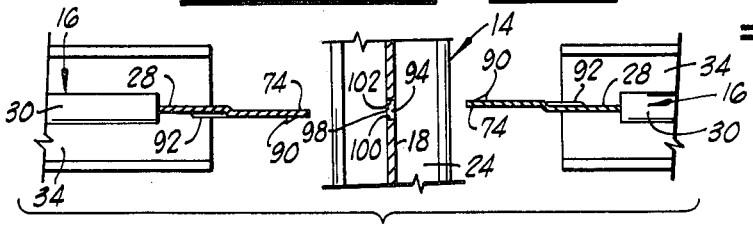
FIG. 11

SUSPENDED CEILING SYSTEM AND RUNNER JOINTS THEREFOR

BACKGROUND OF THE INVENTION

1. Field of the Invention

This invention relates generally to suspended ceiling systems for supporting a plurality of ceiling panels, and more particularly, but not by way of limitation, to suspended ceiling systems employing a plurality of interconnected main and cross runners assembled to form a grid structure for supporting a plurality of ceiling panels or the like.

2. Description of the Prior Art

The prior art includes a number of schemes for the construction of grid systems for supporting ceiling panels. However, many of the prior systems are unsatisfactory due to the insufficient strength of the connections between abutting aligned main runners. Other of the prior art systems fail to provide secure connection of the cross runners to the medial portion of the main runners, thereby permitting the inadvertent disconnection of the cross runners from the main runners when the ceiling panels are being installed on the grid system.

Summary of the Invention

The present invention relates to a grid system for supporting ceiling panels or the like of the type which includes a plurality of longitudinal beams in a spaced parallel relation with each longitudinal beam including a plurality of main runners in aligned connection with each other, and a plurality of cross runners in parallel spaced relation normal to and interconnecting adjacent parallel longitudinal beams. Each main runner includes an intermediate elongated web portion having a longitudinally extending reinforcing bead portion along one longitudinal edge thereof and a longitudinally extending flange portion along the opposite edge portion thereof for supporting ceiling panels or the like. Each cross runner includes an intermediate elongated web portion having a reinforcing bead portion extending along one edge portion thereof and a flange portion extending along the opposite edge portion thereof for supporting ceiling panels or the like.

Improvement in this grid system includes a tongue portion integrally joined with and extending longitudinally from each end of the web portion of each main runner. Each tongue portion is laterally offset with respect to the respective web portion a distance approximately equal to the thickness of the web portion and is disposed wholly on the same side of the plane of the web portion. Each tongue portion has substantially parallel upper and lower edge portions in substantial alignment with the longitudinal axis of the respective main runner.

First detent means form in each tongue portion a distance from the respective end of the web portion for connecting the respective main runner to a like main runner is also included. Each first detent means is struck out from the respective tongue portion in the same direction as the offset of the respective tongue portion to the respective web portion.

First guide loop means formed in each end portion of the web portion and spaced a distance from the respective end thereof for receiving the tongue portion of a like main runner therethrough is also included. Each first guide loop means is struck out from the respective web portion in the opposite direction from the offset of said respective tongue portion relative to the respective web portion and a distance approximately equal to at least twice the thickness of the respective web portion.

The improvement further includes first detent engaging surface means formed on each first guide loop means distal from the respective end of the web portion of the respective main runner for engaging said first detent means of a like main runner and connecting the respective main runner and a like main runner in longitudinally aligned relation.

The improved grid system also includes first web cam surface means struck out from each end portion of each web portion adjacent to the respective first detent engaging surface means and in the same direction as the offset of said respective tongue portion of the respective main runner for camming a tongue portion of a like main runner into alignment with the respective web portion of the respective main runner when said first web cam surface means is engaged by the tongue portion of the like main runner as the main runners are connected.

The improvement further includes first loop cam surface means struck out from each first guide loop means proximate to the respective end of the web portion of the respective main runner and in the opposite direction from the offset of said respective tongue portion of the respective main runner for camming the tongue portion of a like main runner toward the web portion of the respective main runner as the main runners are connected.

It is, therefore, an object of the present invention to provide an improved ceiling grid system for supporting ceiling panels or the like which may be easily erected in a minimum amount of time.

Another object of the invention is to provide a ceiling grid system which may be easily assembled to provide a relatively rigid structure which will not become inadvertently disassembled during the installation of ceiling panels or the like.

A further object of the invention is to provide a novel joint for interconnecting longitudinal main runners in aligned relation which may be simply and easily connected, resist inadvertent disconnection, and provide great structural strength for supporting ceiling panels or the like.

Still another object of the invention is to provide an improved connection joint for cross runners which may be quickly and easily connected to the medial portion of a main runner, resists inadvertent disconnection during the installation of ceiling panels or the like, and provides sufficient structural strength to support ceiling panels or the like.

A still further object of the invention is to provide an improved ceiling grid structure which is economical to manufacture, simple and easy to erect, and structurally sound.

Other objects and advantages of the invention will be evident from the following detailed description when read in conjunction with the accompanying drawings.

BRIEF DESCRIPTION OF THE DRAWINGS

FIG. 6 is a cross-sectional view taken along line 6—6 of FIG. 4.

FIG. 7 is a cross-sectional view taken along line 7—7 of FIG. 4.

FIG. 8 is a fragmentary perspective view of two cross runners in aligned relation and a main runner positioned therebetween and normal thereto prior to the interconnection of the cross runners and the main runner.

FIG. 9 is a fragmentary perspective view of the two cross runners and the main runner of FIG. 8 interconnected to form a rigid structure.

FIG. 10 is a fragmentary side elevation view of two cross runners in aligned relation and a main runner positioned therebetween and normal thereto prior to the interconnection of the cross runners and the main runner.

FIG. 11 is a fragmentary cross-sectional view of the two cross runners and the main runner of FIG. 10 taken along line 11—11 of FIG. 10.

FIG. 12 is a fragmentary side elevation of the two cross runners and the main runner of FIG. 10 interconnected to form a rigid structure.

DESCRIPTION OF THE PREFERRED EMBODIMENT

Figure 1:
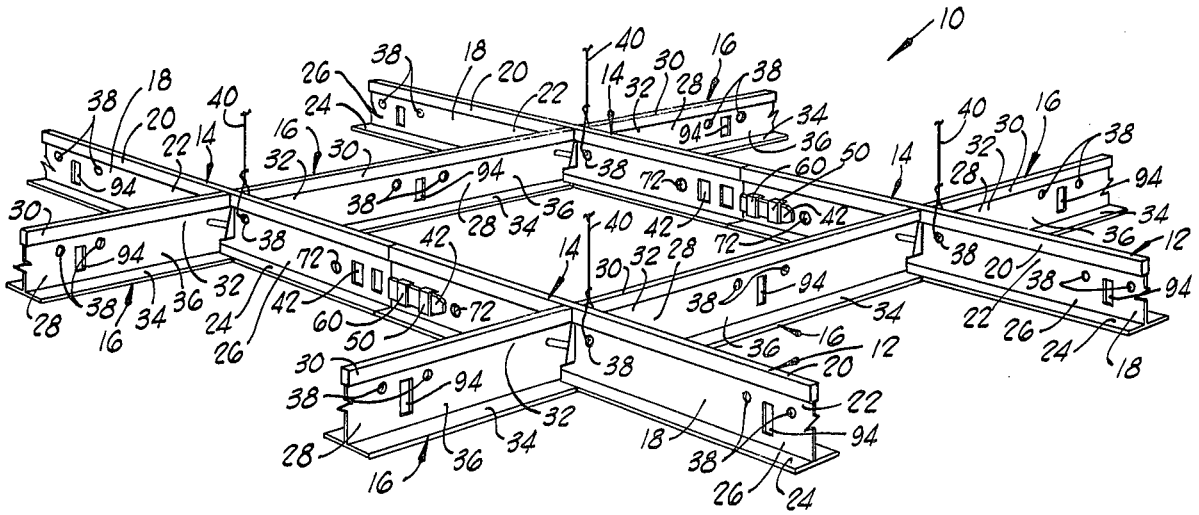
FIG. 1 is a fragmentary perspective view of a portion of the ceiling grid system of the present invention.
Figure 2:
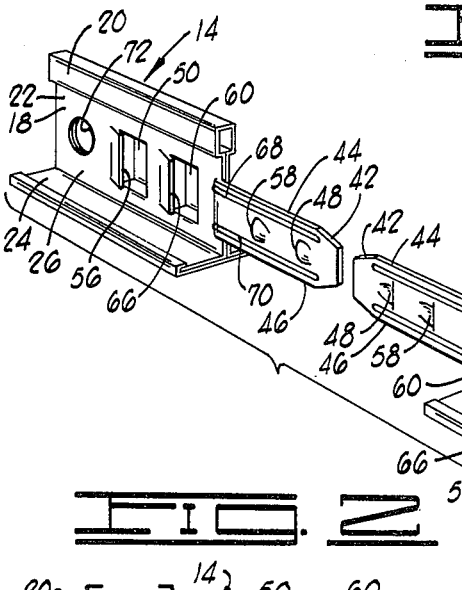
FIG. 2 is a fragmentary perspective view of two main runners in aligned relation prior to the interconnection thereof.
Figure 3:
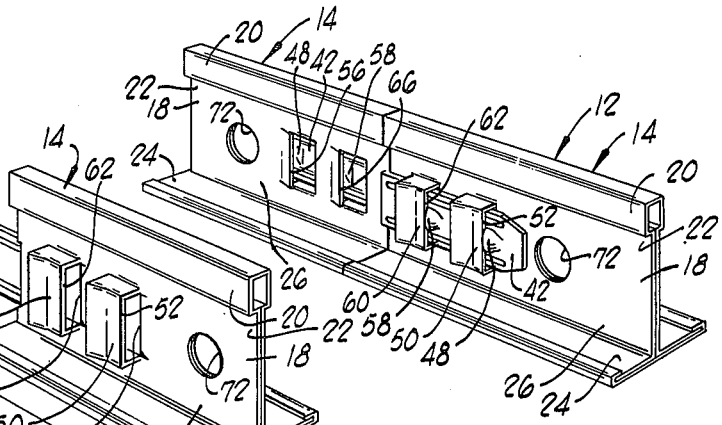
FIG. 3 is a fragmentary perspective view of the two main runners of FIG. 2 interconnected to form a rigid structure.
Figure 4:
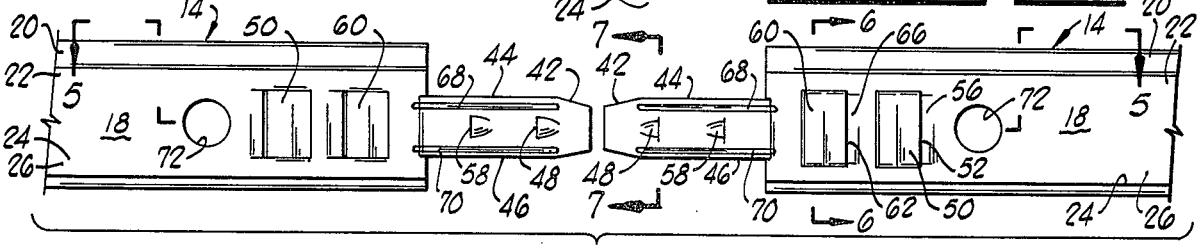
FIG. 4 is a fragmentary side elevation view of two main runners in aligned relation prior to the interconnections thereof.
Figure 5:
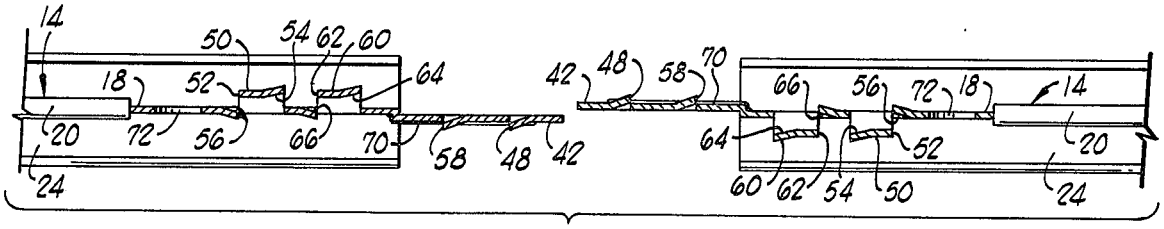
FIG. 5 is a fragmentary cross-sectional view of the two main runners of FIG. 4 taken along line 5—5 of FIG. 4.

Referring now to the drawings, and to FIG. 1 in particular, the suspended ceiling system of the present invention includes a grid system for supporting ceiling panels or the like which is generally designated by the reference character 10. The grid system 10 includes a plurality of longitudinal beams 12 aligned in spaced parallel relation, with each longitudinal beam 12 comprising one or more main runners 14 in aligned connection with each other. The grid system 10 further includes a plurality of cross runners 16 positioned in parallel spaced relation normal to and interconnecting adjacent parallel longitudinal beams 12.

Each main runner 14 includes an intermediate elongated web portion 18 having a longitudinally extending reinforcing bead portion 20 formed along the upper edge portion 22 thereof, and a longitudinally extending flange portion 24 formed along the lower edge portion 26 thereof for supporting ceiling panels or the like.

Each cross runner 16 includes an intermediate elongated web portion 28 having a reinforcing bead portion 30 formed along the upper edge portion 32 thereof, and a flange portion 34 formed along the lower edge portion 36 thereof for supporting ceiling panels or the like.

Apertures 38 are formed in the web portion 18 of each main runner 14 and in the web portion 28 of each cross runner 16 to facilitate the installation of the grid system 10 beneath a conventional ceiling or overhead structure. The grid system 10 may be suspended from such conventional ceiling or overhead structure by a plurality of hangers 40 the lower ends of which are secured to the grid system 10 preferably through an aperture 38 adjacent to the interconnection of two cross runners 16 and a main runner 14. Many apertures 38 are provided in a typical grid system 10, however, it will be readily apparent that all the apertures 38 need not be utilized to satisfactorily suspend the grid system 10 beneath a conventional ceiling or overhead structure.

Description of the Apparatus of FIGS. 2–7

Referring now to FIGS. 2–7, there is illustrated therein novel means for rigidly interconnecting two longitudinally aligned main runners 14 to form a rigid longitudinal beam 12. It will be noted that the end portions of the main runners 14 illustrated in FIGS. 2–5 are identical in construction. Each main runner 14 includes a tongue portion 42 joined with and extending longitudinally from the end of the web portion 18 thereof. Each tongue portion 42 is laterally offset with respect to the respective web portion 18 a distance substantially equal to the thickness of the web portion 18, as most clearly shown in FIG. 5. Each tongue portion 42 is disposed wholly on the same side of the plane of the respective web portion 18, with each tongue portion 42 having substantially parallel upper and lower edge portions 44 and 46 in substantial alignment with the longitudinal axis of the respective main runner 14.

Each tongue portion 42 includes first detent means formed thereon a distance from the respective end of the web portion 18 for connecting the respective main runner 14 to a like main runner. The first detent means comprises a first detent tab 48 struck out from the tongue portion 42 in the same direction as the offset of the tongue portion 42 to the respective web portion 18.

A first guide loop 50 is formed in the end portion of the web portion 18 and is spaced a distance from the respective end thereof. The first guide loop 50 is struck out from the respective web portion 18 in the opposite direction from the offset of the respective tongue portion 42 relative to the web portion 18. The first guide loop 50 is struck out a distance substantially equal to at least twice the thickness of the respective web portion 18. The first guide loop 50 is sized and shaped to slidingly receive therethrough the tongue portion 42 of a like main runner 14 to which the respective main runner 14 is to be connected. Each first guide loop 50 includes a first detent engaging surface 52 formed thereon distal from the respective end of the web portion 18 of the respective main runner 14 for engaging the first detent tab 48 of a like main runner 14 and thereby connecting the respective main runner 14 and the like main runner 14 in longitudinally aligned relation. See FIG. 3. The first guide loop 50 also includes a first loop cam surface 54 struck out from the respective first guide loop 50 proximate to the respective end of the web portion 18 of the respective main runner 14 and in the opposite direction from the offset of the respective tongue portion 42 of the respective main runner 14 for camming the tongue portion 42 of a like main runner 14 toward the web portion 18 of the respective main runner 14 as the two main runners are connected.

A first web cam surface 56 is struck out from the end portion of the respective web portion 18 adjacent to the respective first detent engaging surface 52 and in the same direction as the offset of the respective tongue portion 42 of the respective main runner 14 for camming the tongue portion 42 of a like main runner 14 into alignment with the respective web portion 18 of the respective main runner 14 when the first web cam surface 56 is engaged by the tongue portion 42 of the like main runner 14 as the two main runners are connected.

Each tongue portion 42 includes second detent means formed thereon intermediate the first detent tab 48 and the respective end of the web portion 18 for connecting the respective main runner 14 to a like main runner. The second detent means comprises a second detent tab 58 struck out from the respective tongue portion 42 in the same direction as the first detent tab 48. The first and second detent tabs 48 and 58 are preferably positioned in alignment with the longitudinal axis of the respective main runner 14 and equidistant from the upper and lower edge portions 44 and 46 of the respective tongue portion 42. A second guide loop 60 is formed in the end portion of the respective web portion 18 intermediate the respective first guide loop 50 and the respective end of the web portion 18. The second guide loop 60 is struck out from the respective web portion 18 in the same direction as the first guide loop 50. The second guide loop 60 is struck out a distance substantially equal to at least twice the thickness of the respective web portion 18, and is sized and shaped substantially identical to the first guide loop 50 described above. The second guide loop 60 includes a second detent engaging surface 62 formed thereon distal from the respective end of the web portion 18 of the respective main runner 14 for engaging the second detent tab 58 of a like main runner 14 and connecting the respective main runner 14 and a like main runner in longitudinally aligned relation. See FIG. 3. The second guide loop 60 also includes a second loop cam surface 64 struck out therefrom proximate to the respective end of the web portion 18 of the respective main runner 14 and in the same direction as the first loop cam surface 54 for camming the tongue portion 42 of the like main runner 14 toward the web portion 18 of the respective main runner 14 as the two main runners are connected.

A second web cam surface 66 is struck out from the respective end portion of the respective web portion 18 adjacent to the respective second detent engaging surface 62. The second web cam surface 66 is struck out from the web portion 18 in the same direction as the first web cam surface 56 of camming the tongue portion 42 of a like main runner 14 into alignment with the respective web portion 18 of the respective main runner 14 when the second web cam surface 66 is engaged by the tongue portion 42 of a like main runner 14 as the two main runners are connected.

Each tongue portion 42 includes a pair of parallel reinforcing ribs 58 and 70 formed therein and extending longitudinally therefrom into the respective web portion 18 for reinforcing the tongue portion 42 relative to the web portion 18. The preferred configuration of the reinforcing ribs 68 and 70 is clearly illustrated in FIGS. 4, 5 and 7.

An aperture 72 is formed in the web portion 18 of the respective main runner 14 proximate to the first web cam surface 56. The aperture 72 affords means for connecting a hanger 40 or the like to the main runner 14 to provide support therefor.

Operation of the Apparatus of FIGS. 2–7

In order to rigidly connect two main runners 14 in longitudinal alignment, the two main runners 14 are held in longitudinal alignment and the tongue portion 42 of one main runner 14 is inserted into the second guide loop 60 of the other main runner 14, while simultaneously the tongue portion 42 of the other main runner 14 is inserted into the second guide loop 60 of the first main runner 14. The two main runners 14 are then forced together in longitudinal alignment until the tongue portion 42 of each main runner 14 is fully received through the first and second guide loops 50 and 60 of the other main runner 14, at which time the respective web portions 18 of the main runners 14 will abut one another and the first and second detent tabs 48 and 58 of each main runner 14 will engage the corresponding first and second detent engaging surfaces 52 and 62 of the other main runner 14 thereby securely interconnecting the two main runners 14 as clearly illustrated in FIG. 3.

It will be readily apparent that the previously described interconnection of the two main runners 14 forms a longitudinal beam 12. Such a longitudinal beam 12 is not susceptible to inadvertent disconnection after the two main runners 14 are once assembled.

Description of the Apparatus of FIGS. 8–12

Referring now to FIGS. 8–12, there is illustrated therein novel means for rigidly interconnecting two aligned cross runners 16 to a respective longitudinal main runner 14 disposed therebetween and in normal relation thereto. It will be noted that the end portions of the cross runners 16 illustrated in FIGS. 8–12 are identical in construction. Each cross runner 16 includes a tongue portion 74 jointed with and extending from the end of the web portion 28 thereof. Each tongue portion 74 is laterally offset with respect to the respective web portion 28 a distance substantially equal to the thickness of the web portion 28, as most clearly shown in FIG. 11. Each tongue portion 74 is disposed wholly on the same side of the plane of the respective web portion 28, with each tongue portion 74 having a lower edge portion 76 in substantial parallel alignment with the flange portion 34 of the respective cross runner 16. The upper edge portion 78 of the tongue portion 74 includes a straight surface portion 80 extending from the respective end of the web portion 28 of the cross runner 16 adjacent to and in substantial parallel alignment with the upper edge portion 32 thereof and the lower edge of the respective reinforcing bead portion 30 thereof. A vertical portion 82 extends downwardly from the straight surface portion 80 and intersects a slightly downwardly inclined portion 84 to complete the upper edge portion 78 of the tongue portion 74.

The tongue portion 74 further includes tab means formed on the lower edge portion 76 thereof which includes a vertical portion 86 extending downwardly from the lower edge portion 76 and a substantially straight portion 88 intersecting the vertical portion 86 and extending away from the web portion 28 and in substantial parallel alignment with the lower edge portion 76 of the tongue portion 74.

Detent means in the form of a detent tab 90 is formed in each tongue portion 74 for engaging the web portion 18 of a respective main runner 14. Each detent tab 90 is struck out from the respective tongue portion 74 in the same direction as the offset of tongue portion 74 relative to the web portion 28 of the respective cross runner 16.

Each tongue portion 74 includes a reinforcing rib 92 extending therefrom and formed in the adjacent end of the respective web portion 28 of the respective cross runner 16.

As shown in FIGS. 8–12, the main runner 14 to which the cross runners 16 are to be connected includes a vertically oriented slot 94 formed in the web portion 18 of the main runner 14. The slot 94 is disposed intermediate the two apertures 38. It should be noted that in the manufacture of the main runners 14, the cluster comprising the slot 94 and the two apertures 38, as most clearly shown in FIG. 8, is preferably located on 6 inch centers over the entire length of the main runner 14. Each slot 94 includes an upper end 96, a lower end 98, and opposite sides 100 and 102. The width of the slot 94 between the sides 100 and 102 is of such size as to receive therethrough the respective tongue portions 74 of abutting cross runner 16 for assembly of the cross runner 16 and the main runner 14 as will be described thereinafter.

Operation of the Apparatus of FIGS. 8–12

In order to rigidly interconnect the two cross runners 16 and the main runner 14, as best illustrated in FIGS. 9 and 12, the two cross runners 16 are held in longitudinal alignment and the respective tongue portions 74 are inserted through the slot 94 in the main runner 14 from opposite sides of the main runner 14, one at a time.

Each cross runner 16 is in proper position relative to the main runner 14 when the lower edge portion 76 of the respective tongue portion 74 is positioned over and in contact with the lower end 98 of the slot 94. The straight surface portion 80 of the respective tongue portion 74 is positioned beneath and is in contact with the lower edge of the reinforcing bead portion 20 of the main runner 14 thereby retaining the lower edge portion 76 in contact with the lower end 90 of the slot 94. The detent tab 90 of the respective tongue portion 74 engages the web portion 18 of the main runner 14, and the vertical portion 86 of the tongue portion 74 also engages the web portion 18 of the main runner 14 below the lower end 98 of the slot 94, thereby preventing the disengagement and withdrawal of the respective cross runner 16 from the main runner 14, as clearly illustrated in FIGS. 9 and 12. It will be readily apparent that the engagement of the straight surface portion 80, the detent tab 90, the lower edge portion 76 and the vertical portion 86 of the tongue portion 74 of each of the two cross runners 16 with the main runner 14 as described above provides a rigid interconnection of the two cross runners 16 and the main runner 14 which restricts linear and angular movement of each cross runner 16 relative to the main runner 14 thereby preventing the disengagement thereof. The previously described apertures 38 afford means for connecting a hanger 40 or the like to the main runner 14 to provide support for the grid system 10 at the juncture of the two cross runners 16 and the main runner 14.

It will be readily apparent to those skilled in the art that the previously described cluster comprising the slot 94 and the two accompanying apertures 38 may also be formed in the web portion 28 of the cross runners 16, such as on 6 inch centers as mentioned above for the main runner 14. By selection of various lengths of main runners 14 and cross runners 16, virtually any grid system pattern may be fabricated to form ceiling structures in the desired configuration.

The main runners 14 and cross runners 16 described above may be suitably constructed of rolled and stamped thin sheet metal such as aluminum or steel. While the construction of the main and cross runners 14 and 16 is shown to be of the two piece variety, it will be readily apparent that the novel grid structure and interconnection features disclosed herein are readily applicable to main and cross runners formed of a single piece of relatively thin sheet metal.

It is believed apparent that the apparatus disclosed in the present invention readily obtains the objectives set forth herein. Changes may be made in the arrangement or combination of parts or elements shown in the drawings and described in the specification without departing from the spirit and scope of the invention as defined in the following claims.

What is claimed is:

1. In a grid system for supporting ceiling panels or the like of the type which includes a plurality of longitudinal beams in spaced parallel relation with each longitudinal beam including a plurality of main runners in aligned connection with each other, and a plurality of cross runners in parallel spaced relation normal to and interconnecting adjacent parallel longitudinal beams, each main runner including an intermediate elongated web portion having a longitudinally extending reinforcing bead portion along one longitudinal edge portion thereof and a longitudinally extending flange portion along the opposite edge portion thereof for supporting ceiling panels or the like, and each cross runner including an intermediate elongated web portion having a reinforcing bead portion extending along one edge portion thereof and a flange portion extending along the opposite edge portion thereof for supporting ceiling panels or the like, the improvement comprising:

a tongue portion integrally joined with and extending longitudinally from each end of the web portion of each main runner, each tongue portion being laterally offset with respect to the respective web portion a distance approximately equal to the thickness of the web portion and disposed wholly on the same side of the plane of the web portion, each tongue portion having substantially parallel upper and lower edge portions in substantial alignment with the longitudinal axis of the respective main runner;

a first detent means formed in each tongue portion a distance from the respective end of the web portion for connecting the respective main runner to a like main runner, each first detent means being struck out from the respective tongue portion in the same direction as the offset of the respective tongue portion relative to the respective web portion;

first guide loop means formed in each end portion of the web portion and spaced a distance from the respective end thereof for receiving the tongue portion of a like main runner therethrough, each first guide loop means being struck out from the respective web portion in the opposite direction from the offset of said respective tongue portion relative to the respective web portion and a distance approximately equal to at least twice the thickness of the respective web portion;

first detent engaging surface means formed on each first guide loop means distal from the respective end of the web portion of the respective main runner for engaging said first detent means of a like main runner and connecting the respective main runner and a like main runner in longitudinally aligned relation;

first web cam surface means struck out from each end portion of each web portion adjacent to the respective first detent engaging surface means and in the same direction as the offset of said tongue portion of the respective main runner for camming the tongue portion of a like main runner into alignment with the respective web portion of the respective main runner when said first web cam surface means is engaged by the tongue portion of the like main runner as the main runners are connected; and first loop cam surface means struck out from each first guide loop means proximate to the respective end of the web portion of the respective main runner and in the opposite direction from the offset of said respective tongue portion of the respective main runner for camming the tongue portion of a like main runner toward the web portion of the respective main runner as the main runners are connected.

2. A grid system as defined in claim 1 characterized further to include:

connecting means formed on each end of each cross runner for connecting each end of a cross runner to a respective main runner; and means formed on each main runner for engaging said connecting means.

3. A grid system as defined in claim 2 wherein said means formed on each main runner for engaging said connecting means is characterized further to include:

vertically extending slot means formed in the web portion of a size for receiving therein said connecting means of two abutting aligned cross runners with the web portion of the respective main runner disposed therebetween; and wherein said connecting means is characterized further to include:

a tongue portion integrally joined with and extending from each end of the web portion of each cross runner, each tongue portion being laterally offset with respect to the respective web portion a distance approximately equal to the thickness of the web portion and disposed wholly on the same side of the plane of the web portion, each tongue portion having tab means formed on the lower edge portion thereof for engaging the web portion of a respective main runner below the lower edge of said respective slot means when the respective main runner and cross runner are in their assembled positions;

detent means formed on each tongue portion of a respective cross runner for engaging the web portion of a respective main runner at one side of said respective slot means when the respective main runner and cross runner are in their assembled positions, each detent means being struck out from the respective tongue portion in the same direction as the offset of the tongue portion relative to the web portion of the respective cross runner; and means formed on each tongue portion for engaging the bead portion of a respective main runner for restricting linear and angular movement of each cross runner relative to the respective main runner to which each cross runner is connected to prevent disengagement of said respective tab means from the web portion of the respective main runner.

4. A grid system as defined in claim 3 characterized further to include:

second detent means formed on each tongue portion intermediate said first detent means and the respective end of the web portion for connecting the respective main runner to a like main runner, each second detent means being struck out from the respective tongue portion in the same direction as said first detent means;

second guide loop means formed in each end portion of the web portion intermediate said first guide loop means and the respective end of the web portion for receiving the tongue portion of a like main runner therethrough, each second guide loop means being struck out from the respective web portion in the same direction as said first guide loop means and a distance approximately equal to at least twice the thickness of the respective web portion;

second detent engaging surface means formed on each second guide loop means distal from the respective end of the web portion of the respective main runner for engaging said second detent means of a like main runner and connecting the respective main runner and a like main runner in longitudinally aligned relation;

second cam surface means struck out from each end portion of each web portion adjacent to the respective second detent engaging surface means and in the same direction as said first web cam surface means for camming the tongue portion of a like main runner into alignment with the respective web portion of the respective main runner when said second web cam surface means is engaged by the tongue portion of the like main runner as the main runners are connected; and second loop cam surface means struck out from each second guide loop means proximate to the respective end of the web portion of the respective main runner and in the same direction as said first loop cam surface means for camming the tongue portion of a like main runner toward the web portion of the respective main runner as the main runners are connected.

5. A grid system as defined in claim 4 wherein said means formed on each tongue portion of a respective cross runner for engaging the bead portion of a respective main runner is characterized further to include:

straight surface means formed on the upper edge of each tongue portion of a respective cross runner and extending a distance from each end of the web portion thereof in substantial alignment with the lower edge portion of the bead portion thereof for extending beneath and engaging the lower edge portion of the bead portion of the respective main runner.

6. A grid system as defined in claim 5 wherein said connecting means is characterized further to include:

reinforcing means formed in each end of the web portion of each cross runner and integrally joining said respective tongue portion adjacent thereto for reinforcing each said tongue portion.

7. In combination with a main runner for aligned connection with a like main runner, which main runner includes an intermediate elongated web portion having a longitudinally extending reinforcing bead portion along one longitudinal edge portion thereof and a longitudinally extending flange portion along the opposite edge portion thereof for supporting ceiling panels or the like, the improvement comprising:

a tongue portion integrally joined with and extending longitudinally from one end of the web portion, said tongue portion being laterally offset with respect to the web portion a distance approximately equal to the thickness of the web portion and disposed wholly on the same side of the plane of the web portion, said tongue portion having substantially parallel upper and lower edge portions in substantial alignment with the longitudinal axis of the main runner;

first detent means formed in said tongue portion a distance from the one end of the web portion for connecting the main runner to a like main runner, said first detent means being struck out from said tongue portion in the same direction as the offset of said tongue portion relative to the web portion;

first guide loop means formed in the web portion a distance from the one end thereof for receiving the tongue portion of a like main runner therethrough, said first guide loop means being struck out from the web portion in the opposite direction from the offset of said tongue portion relative to the web portion and a distance approximately equal to at least twice the thickness of the web portion;

first detent engaging surface means formed on said first guide loop means distal from the one end of the web portion of the main runner for engaging said first detent means of a like main runner and connecting the main runner and a like main runner in longitudinally aligned relation;

first web cam surface means struck out from the web portion adjacent to the first detent engaging surface means and in the same direction as the offset of said tongue portion of the main runner for camming the tongue portion of a like main runner into alignment with the web portion of the main runner when said first web cam surface is engaged by the tongue portion of the like main runner as the two main runners are connected; and first loop cam surface means struck out from the first guide loop means proximate to the one end of the web portion of the main runner and in the opposite direction from the offset of said tongue portion of the main runner for camming the tongue portion of a like runner toward the web portion of the main runner as the two main runners are connected.

8. The improved main runner as defined in claim 7, characterizeed further to include:

second detent means formed in said tongue portion intermediate said first detent means and the one end of the web portion for connecting the main runner to a like main runner, said second detent means being struck out from said tongue portion in the same direction as said first detent means;

second guide loop means formed in the web portion intermediate said first guide loop means and the one end thereof for receiving the tongue portion of a like main runner therethrough, said second guide loop means being struck out from the web portion in the same direction and substantially the same distance as said first guide loop means;

second detent engaging surface means formed on said second guide loop means distal from the one end of the web portion of the main runner for engaging said second detent means of a like main runner and connecting the main runner and a like main runner;

second web cam surface means struck out from the web portion adjacent to the second detent engaging surface means and in the same direction as the offset of said tongue portion of the main runner for camming the tongue portion of a like main runner into alignment with the web portion of the main runner when engaged by the tongue portion of the like main runner as the two main runners are connected; and second loop cam surface means struck out from the second guide loop means proximate to the one end of the web portion of the main runner and in the same direction as said first loop cam surface means.

9. The improved main runner as defined in claim 8 characterized further to include:

longitudinally extending reinforcing means formed in said tongue portion and in the web portion for reinforcing said tongue portion.

* * * * *

PO-1050
(5/69)

UNITED STATES PATENT OFFICE
CERTIFICATE OF CORRECTION

Patent No. 3,979,874 Dated September 14, 1976

Inventor(s) Ralph J. Cubbler, Jr. and Kyle E. Lucas

It is certified that error appears in the above-identified patent and that said Letters Patent are hereby corrected as shown below:

Column 5, line 53, "58" should be --68--.

Column 6, line 31, "jointed" should be --joined--.

Column 7, line 18, "thereinafter" should be --hereinafter--.

Column 8, line 45, delete "a", first occurrence.

Column 12, line 1, insert "main" between the words "like runner".

Signed and Sealed this

Sixteenth Day of November 1976

[SEAL]

*Attest:*

RUTH C. MASON
*Attesting Officer*

C. MARSHALL DANN
*Commissioner of Patents and Trademarks*